US005547251A

United States Patent [19]

Axelson

[11] Patent Number: 5,547,251

[45] Date of Patent: Aug. 20, 1996

[54] BACK SUPPORT ADJUSTING APPARATUS FOR CHAIR WITH BACKREST FLEXIBLE UPHOLSTERY

[75] Inventor: Peter W. Axelson, Santa Cruz, Calif.

[73] Assignee: Beneficial Designs, Inc., Santa Cruz, Calif.

[21] Appl. No.: 252,326

[22] Filed: Jun. 1, 1994

[51] Int. Cl.[6] ..... A47C 7/42

[52] U.S. Cl. ..... 297/284.5; 297/188.04; 297/284.7; 297/452.35; 297/DIG. 4

[58] Field of Search ..... 297/188.04, 188.06, 297/229, 230.14, 284.20, 284.4, 284.5, 284.7, 440.20, 452.32, 452.32, 452.35, DIG. 4, 228.17, DIG. 6

[56] References Cited

U.S. PATENT DOCUMENTS

| | | | |
|---|---|---|---|
| 2,056,767 | 10/1936 | Blath | 297/228.12 X |
| 2,900,012 | 8/1959 | McGlone | 297/228.12 |
| 3,220,767 | 11/1965 | Hendrickson | 297/DIG. 6 |
| 3,730,589 | 5/1973 | Lane | 297/284.5 X |
| 4,471,993 | 9/1984 | Watson | 297/284.5 |
| 4,925,242 | 5/1990 | Harris et al. | 297/284.4 |

FOREIGN PATENT DOCUMENTS

| | | | |
|---|---|---|---|
| 46892 | 3/1982 | European Pat. Off. | 297/284.7 |
| 2556197 | 6/1985 | France | 297/284.7 |
| 1105291 | 4/1961 | Germany | 297/284.7 |

*Primary Examiner*—Peter R. Brown
*Attorney, Agent, or Firm*—Welsh & Katz, Ltd.

[57] ABSTRACT

An apparatus for adjusting the back support provided by a backrest of a wheelchair formed with sling construction. The backrest has flexible upholstery and two generally vertical support posts for anchoring the sides of the upholstery so that the upholstery extends between the support posts. When the occupant leans against the upholstery, the apparatus includes at least one cushion which contacts a portion of the upholstery behind the occupant to provide a desired configuration and distribution of support to the back of the occupant. The apparatus also has straps extending between the cushion and the support posts. The straps may be adjusted to position the cushion at a desired location along the rear face of the upholstery and adjust the degree of support provided to the occupant by the apparatus.

14 Claims, 5 Drawing Sheets

14
26
18
64
108
104
58
52
52
102
38
20
16
108
54
66
22
100
106
12
64
18
62
58
46
22
16
44
6
66
6

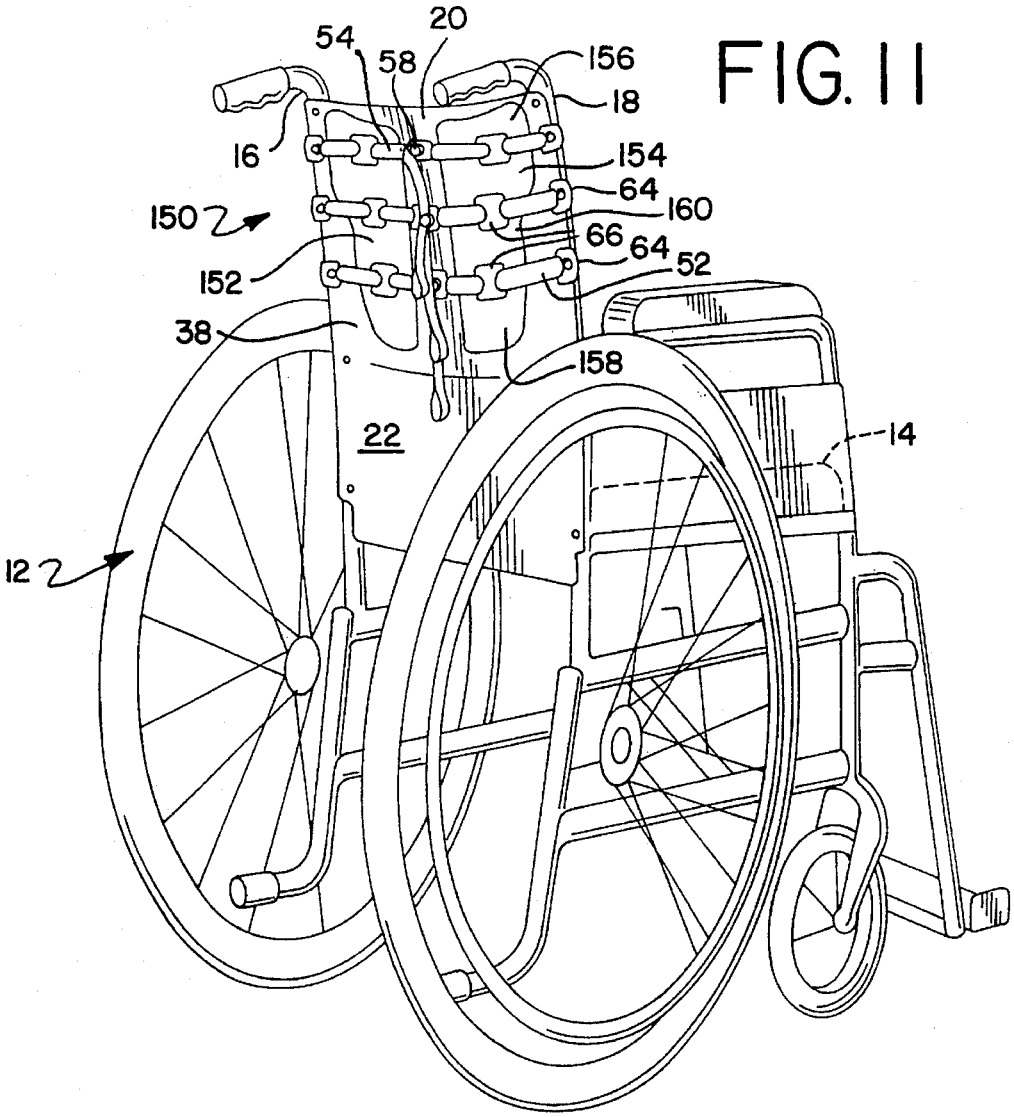
FIG. 11
FIG. 12
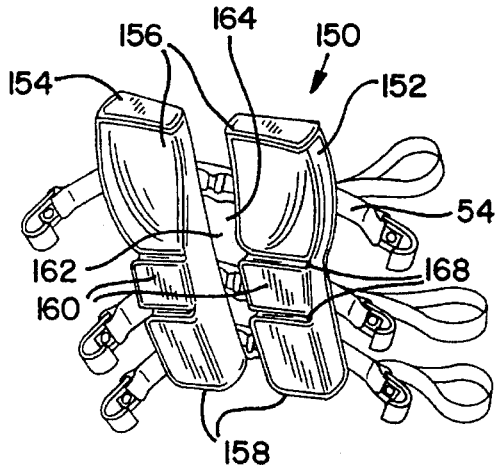

BACK SUPPORT ADJUSTING APPARATUS FOR CHAIR WITH BACKREST FLEXIBLE UPHOLSTERY

BACKGROUND OF THE INVENTION

This invention relates to apparatus for adjusting the support provided by a backrest of a chair, and more particularly, to such an apparatus for use with a chair having a backrest with sling back upholstery which may easily adjust the back support provided by the upholstery to meet the particular demands of an occupant of such a chair.

Several types of chairs employ a backrest formed with sling construction for supporting the back of the occupant. Sling construction generally refers to a backrest having foldable, flexible upholstery with two opposing side edges which are anchored by two generally vertical support posts. Sling construction backrests are typically found in chairs which are constructed to be folded, such as foldable wheelchairs, director chairs or the like.

When an occupant of a chair having such a backrest leans against the upholstery of the backrest, the backrest typically supports the back of the occupant at the initial point of contact between the back and upholstery. Typically the initial point of contact is between the upper portion of the back and upholstery. In addition, the support provided by the upholstery of the backrest is distributed fairly evenly in the lateral direction along the back of the occupant.

A drawback of having the back of the occupant supported by such a backrest is that with the upper portion of the back contacting the upholstery of the backrest, the lower portion of the back is not supported. This lack of support may cause discomfort in the lower back.

Sitting in a chair with a sling construction backrest may also promote posterior tilting of the pelvis and rounding of the spine due to the lack of proper pelvic and lumbo-sacral support. This pelvis tilting and rounding of the spine may cause a permanent deformity of the spine and lower back pain.

An additional drawback of the backrest is that because the support is evenly distributed in the lateral direction, such support is not desired if the occupant experiences discomfort when a particular area on the back, such as the spine, is contacted. Also because the upholstery of the backrest typically assumes a particular configuration when leaned against, individual support needs of the occupant, such as an occupant with atrophied back muscles, are not addressed.

An additional drawback of the backrest is the lack of additional support in the upper back region; however, such support should be evenly distributed in the lateral direction.

The above noted drawbacks are compounded when the occupant spends long periods of time in a chair with a sling construction backrest. For example, wheelchair occupants are typically in such chairs for significant periods of time.

In addition, efforts by the occupant to adjust the degree and distribution of support provided by the backrest may be hindered due to the need to be able to fold the chair and backrest. Often, pads or cushions which are placed in the chair must be removed before the chair may be folded which is a drawback.

It is therefore an object of the present invention to provide an improved apparatus for use with a chair having a sling construction backrest for adjusting the support provided by the backrest to correspond to the individual needs of an occupant. A related object is to provide such an improved apparatus to adjust the support provided by the backrest to provide support or additional support at particular locations along the back of the occupant such as the lower and upper regions of the back.

An additional object of the present invention is to provide an improved apparatus for adjusting the back support provided by a chair constructed to be folded.

SUMMARY OF THE INVENTION

The above objects are met or exceeded by an apparatus for adjusting the back support provided by a backrest of a chair formed with sling construction. The backrest has flexible upholstery and two generally vertical support posts for anchoring the sides of the upholstery so that the upholstery extends between the support posts. The apparatus adjusts the degree and distribution of the back support provided to the occupant by the backrest. When the occupant leans against the upholstery, the support system includes at least one cushion which contacts a rear face of the upholstery to support a portion of the back of the occupant. The apparatus also has at least one strap to selectively attach the cushion to the chair adjacent the rear face of the upholstery. The strap may selectively be attached to the cushion and chair to position the cushion at a desired location along the rear face of the upholstery and the strap may be adjusted to control the degree and distribution of support provided to the occupant by the cushion.

More particularly, the cushion is configured to provide a desired support distribution along a portion of the back of the occupant so as to contour the sitting profile of the chair occupant. The strap is removably and operably connected to the support posts, and the strap includes an adjustment device to adjust the length of the strap and position the cushion relative to the support posts. The position of the cushion along the strap may also be varied.

In alternate embodiments, a plurality of cushions may be provided with the cushions adapted to be positioned at desired locations along the strap. Also a plurality of straps may be provided as well as a multiple of attachment devices for operably connecting the straps to the support posts and upholstery.

BRIEF DESCRIPTION OF THE INVENTION

The present invention will be better understood by reference to the figures of the drawings wherein like numbers denote like parts throughout and wherein:

FIG. 11 is a rear perspective view of an apparatus constructed in accordance with a further alternate embodiment of the present invention;

FIG. 12 is a front perspective view of the apparatus of FIG. 11;

DESCRIPTION OF THE PREFERRED EMBODIMENT

Figure 1:
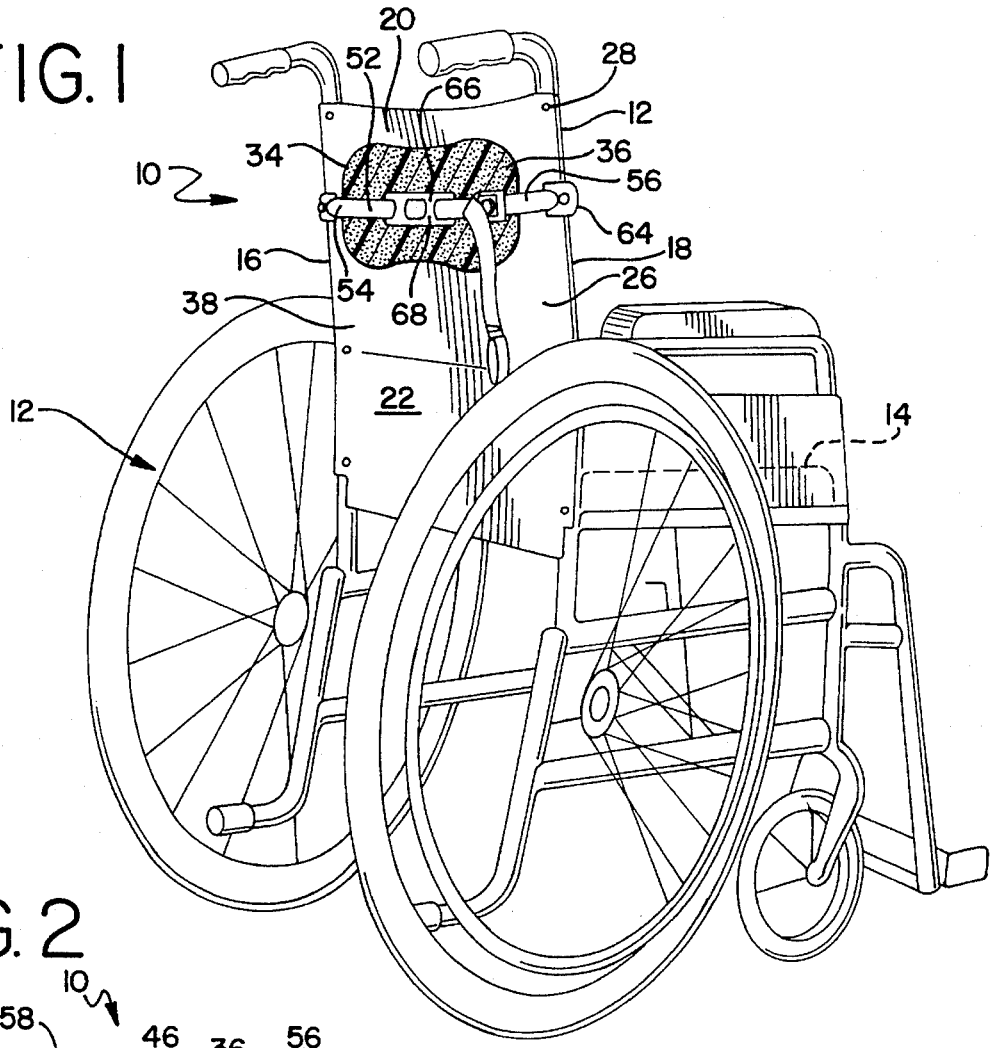
FIG. 1 is a rear perspective view of a back support adjusting apparatus for a wheelchair with a backrest having flexible upholstery constructed in accordance with the present invention and shown attached to a wheelchair.

Referring to FIG. 1, a back support adjusting apparatus constructed in accordance with the present invention is generally designated at 10. The apparatus 10 is shown attached to a foldable wheelchair 12; however, the apparatus may be utilized in other types of chairs and in particular those chairs constructed with back supports having the shown sling construction and also those chairs which may be folded for storage and transportation.

The wheelchair 12 includes a seat 14 and a left generally vertical support post 16 which is coparallel with a right generally vertical support post 18. The left and right posts 16, 18 form a part of a backrest 20 of the wheelchair 12. The backrest 20 also includes upholstery 22 which extends between the support posts 16, 18. The upholstery 22 is typically formed with flexible material and has a front face 24 (FIG. 3) which faces the occupant. The side end portions 26 of the upholstery 22 are attached to the support posts 16, 18 by screws 28. Other attachment arrangements such as a loop which extends about the post 16, 18 may also be used to attach the upholstery 22 to the support posts 16, 18.

The apparatus 10 includes a cushioning arrangement 34 for adjusting the distribution of support provided to the occupant by the upholstery 22 of the backrest to contour the sitting profile of the wheelchair occupant. In the preferred embodiment, the cushioning arrangement 34 has at least one cushion 36 which contacts a rear face 38 of the upholstery 22.

Figure 2:
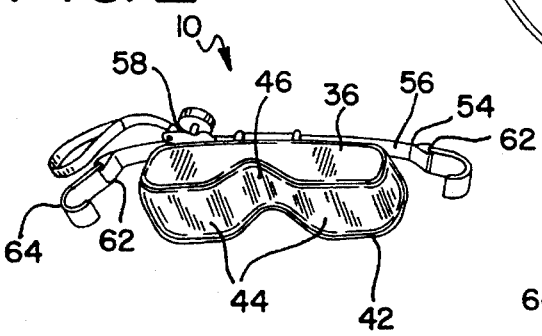
FIG. 2 is a front perspective view of the apparatus of FIG. 1.
Figures 5, 6, 7:
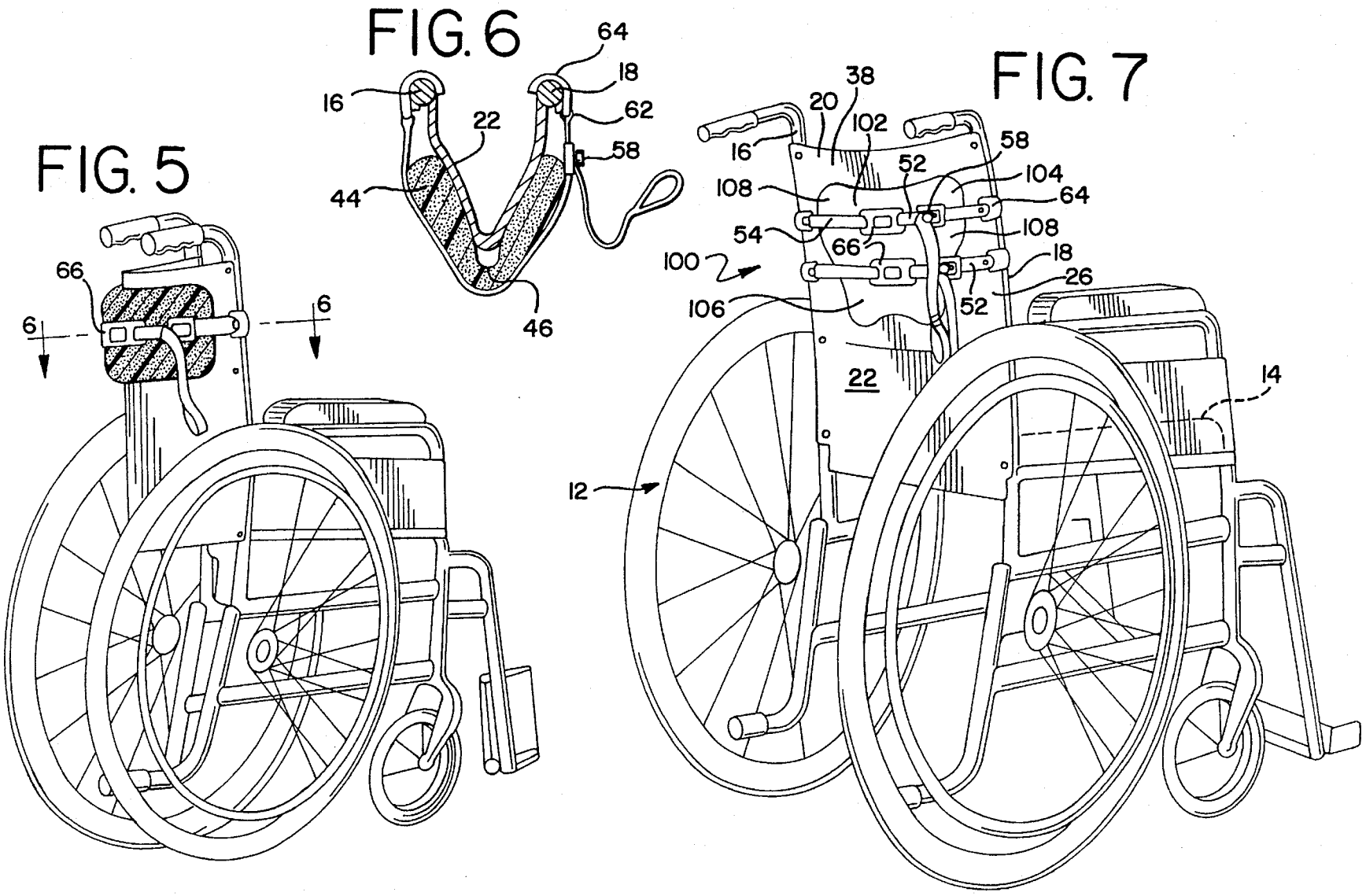
FIG. 5 is a rear perspective view of the apparatus of FIG. 1 with the wheelchair folded.
FIG. 6 is a top sectional view of the apparatus of FIG. 5 taken generally along the line 6—6 and in the indicated direction.
FIG. 7 is a rear perspective view of an apparatus constructed in accordance with an alternate embodiment of the present invention and shown attached to a wheelchair.

Referring also to FIG. 2, the cushion 36 has a front face 42 which is configured to provide a desired distribution of support to the back of the occupant. In particular, it is frequently desirable to provide support on opposite sides of a spine of a patient without contacting the spinal area. Accordingly, the front face 42 of the cushion 36 is configured with two forward extending side portions 44 separated by a recessed center 46. The center 46 provides relief at the spinal area of the occupant and also functions to connect the side portions and maintain the separation and alignment of the side portions. The thickness of the center 46 is also sized so that the cushion 36 folds along the center when the wheelchair 12 is folded by placing the left post 16 generally adjacent the right post 18, as shown in FIGS. 5 and 6.

Referring back to FIGS. 1 and 2 a strapping arrangement 52 removably and selectively attaches the cushion 36 to the wheelchair 12 and positions the cushion at a desired position relative to the posts 16, 18 and upholstery 22. The strapping arrangement 52 includes at least one strap 54 having two end pieces 56 which are connected together so that the total length of the strap 54 may be varied. Preferably the end pieces 56 are connected by an adjusting device 58. At the outer ends 62 of the strap 54 are connectors 64 for selectively and removably attaching the strap to the posts 16, 18 when the wheelchair 12 is either folded or unfolded.

The strap 54 extends through a sleeve 66 which is attached to the rear surface of the cushion 36. The sleeve 66 is preferably attached to the cushion 36 with a hook and pile attachment system so that the location of the sleeve along the rear surface of the cushion may be varied. The sleeve 66 preferably forms a number of belt loops 68 through which the strap 54 is threaded. Adjusting devices 58 may be positioned along the strap 54 on opposite sides of the cushion 36 to facilitate the lateral positioning.

The cushion 36 may also be attached to the strap 54 by sewing or other attachment means. This type of attachment however, reduces the ability to laterally position the cushion 36 relative to the upholstery 22.

Figure 14:
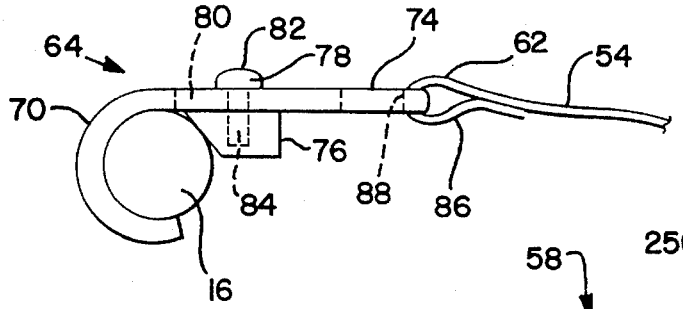
FIG. 14 is a top view of a strap attachment device forming a part of the apparatus of FIG. 1.

Referring to FIG. 14 a preferred embodiment of the connector 64 for selectively and removably attaching the strap 54 to one of the posts 16, 18 is illustrated. The connector 64 is particularly suited for attaching the strap 54 to the side back support post 16, 18 of the wheelchair 12 (FIG. 1) and maintain the attachment while the wheelchair is either unfolded as shown in FIG. 1 or folded as shown in FIG. 5. The connector 64 includes a generally hooked shaped, outer portion 70 adapted to fit about one of the posts 16, 18. The connector 64 also includes an inner straight planar portion 74 extending from the outer portion 70. The connector 64 also includes an adjustable stop 76 to clamp the post 16 between the stop and the outer curve portion 70. The position of the stop 76 is adjustable relative to the planar portions 74 by extending a bolt 78 through a slot 80 extending laterally along the planar portion. The head 82 of the bolt 78 frictionally engages the planar portions 74 while the opposite end 84 of the bolt is threaded into the stop 76. Tightening of the bolt 78 fixes the position of the stop 76 relative to the planar portion. The strap 54 is preferably attached to the connector 64 by formation of a loop 86 at the outer end 62 of the strap with the loop being threaded through a slot 88 formed at the inner end of the planar portion 74.

Figure 3:
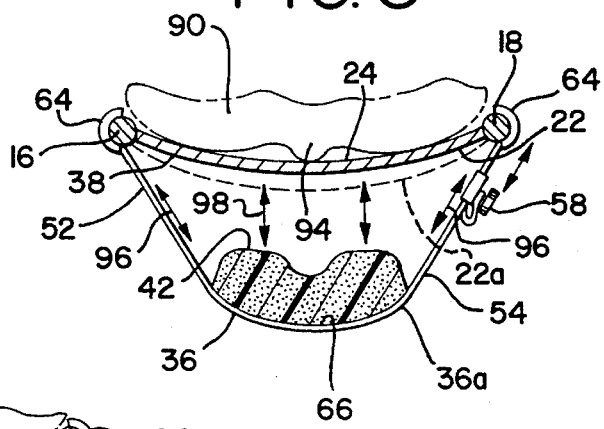
FIGS. 3 and 4 are top views of the apparatus of FIG. 1 adjusted between a first and second position, respectively.
Figure 4:
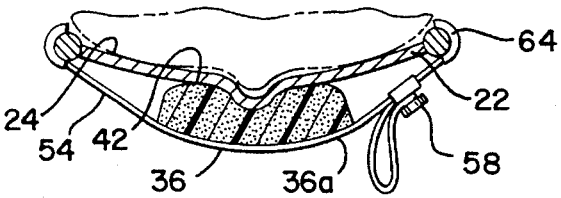

Referring to FIGS. 3 and 4, typically when the occupant leans against the upholstery 22, the upholstery flexes and curves around the back 90 of the occupant to support the occupant. The upholstery 22 may contact and apply pressure on the spinal area 94 of the occupant causing discomfort. In some positions along the upholstery 22, the upholstery may not contact the adjacent back portion of the occupant as shown in shadow at **22*a*** leaving that portion of the back unsupported.

In using the apparatus 10, the clip connectors 64 are attached to the left and right posts 16, 18 at a desired vertical location by clamping the posts 16, 18 between the stop 76 and outer hook portion 70. The strap 54 extends through the sleeve 66, around the rear face **36*a* of the cushion and between the cushion and posts 16, 18. The position of the cushion 36 in the lateral direction, indicated by arrow 96, is adjusted by sliding the cushion along the strap 54. There is preferably a frictional sliding arrangement between the cushion 36 and strap 54** so that the cushion will remain at a point along the strap unless manually moved.

Along with obtaining a satisfactory lateral position, the position of the cushion 36 in the forward direction relative to the posts 16, 18, a direction generally indicated by arrows 98, is altered by adjusting the length of the strap 54 with the adjusting connector 58. Reducing the length of the strap 54 moves the strap forward so that the front face 42 of the cushion 36 contacts the rear face 38 of the upholstery 22 to move a portion of the upholstery forward and also flexibly deform the upholstery of the back rest. The front face 24 of the upholstery 22 deforms to mimic the configuration of the front face 42 of the cushion 36.

Using the strapping arrangement 52 to move a portion of the upholstery 22 forward, may cause the upholstery to contact and support an area of the back 90 not previously supported by the upholstery. Also the cushion 36 supports the back 90 of the occupant on opposite sides of the spinal area 90 providing relief to the spine. As noted above, the lateral position of the cushion 36 may be varied which provides an important adjustment for occupants having curved spines.

Figure 8:
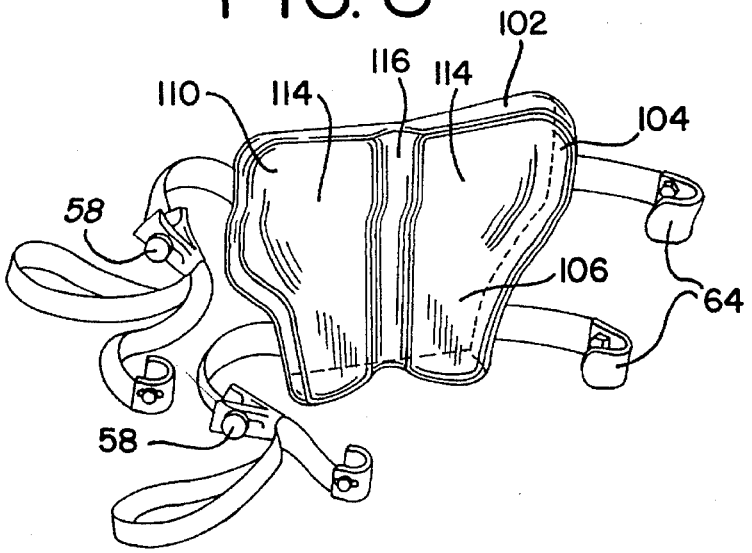
FIG. 8 is a front perspective view of the apparatus of FIG. 7.

Referring to FIGS. 7 and 8, an alternate embodiment of the adjusting apparatus is generally indicated at 100. In the alternate embodiment, the apparatus 100 includes a cushion 102 having an upper portion 104 and a lower portion 106. The lateral sides 108 of the upper portion 104 extend laterally outward in close proximity to the support posts 16, 18 to laterally support the wheelchair occupant thereby maintaining the occupant in an upright position. The lower portion 106 need not be as wide as the upper portion 104 as the lateral support provided by the upper portion 104 is typically sufficient to maintain the occupant in the upright position. The upper portion 104 and lower portion 106 are attached to separate strapping arrangements 52. The upper strapping arrangement 52 may extend through a sleeve 66 attached to the rear of the upper portion 104. Similarly, the lower strapping arrangement 54 may extend through a sleeve 66 attached to the lower portion 106 of the cushion 102. The upper and lower strapping arrangements 54 each include adjustment devices 58.

Figure 9:
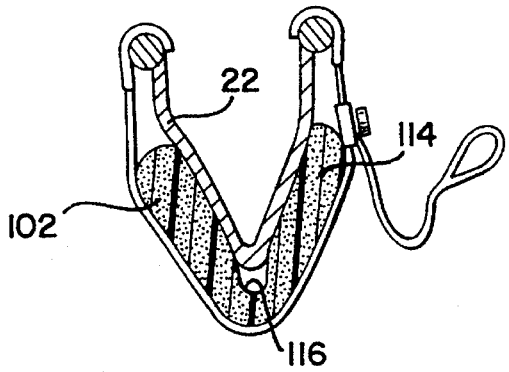
FIG. 9 is a top sectional view of the apparatus of FIG. 7 in a folded position.

The front face 110 of the cushion 102 is configured with two forward extending side portions 114 separated by a recess center 116. The recessed center 116 provides relief to the spinal area of the occupant and connects the side portions of the cushion. The thickness of the center 116 is sized so that the cushion 102 folds along the center when the wheelchair 12 is folded as shown in FIG. 9. Depending upon the needs of the occupant, the recessed center 116 need not extend for the entire vertical distance of the cushion 102.

Use of separate strapping arrangements 52 for the upper portion 104 and lower portion 106 of the cushion 102 allows the position of the upper portion to be adjusted in the forward direction relative to the posts 16, 18 and also relative to the position of the lower portion in the forward direction. Thus, the distribution of the support provided by the upper portion 104 and lower portion 106 of the cushion 102 may be separately adjusted to vary the distribution of support provided by the cushion in the vertical direction along the rear face 38 of the upholstery 22.

Figure 10:
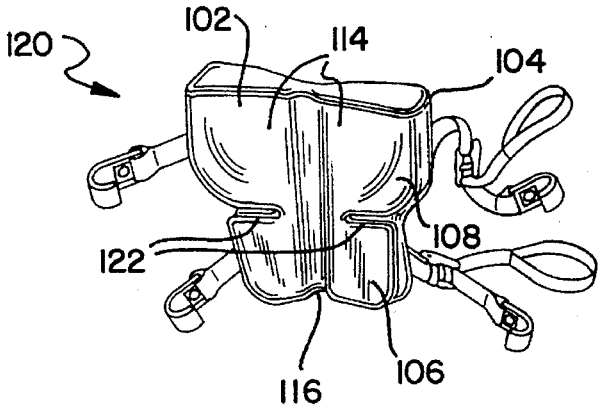
FIG. 10 is a front perspective view of an alternate embodiment of a cushion forming part of the apparatus of FIG. 7.

Referring to FIG. 10, an alternate embodiment of the cushion for the apparatus 100 is generally indicated at 120. The cushion 120 forms a pair of horizontally aligned slit like indentations 122 which separate the upper portion 104 from the lower portion 106. The indentations 122 are preferably formed by reducing the thickness of the side portions 114 of the cushion 102. The slits 122 facilitate the flexing movement of the upper portion 104 relative to the lower portion 106 of the cushion 102, and find particular use when the thickness of the cushion may interfere with the ability to adjust the forward position of the upper portion 104 of the cushion relative to the lower portion 106.

Referring to FIGS. 11 and 12, a further alternate embodiment of the adjusting apparatus of the present invention is generally indicated at 150. The apparatus 150 includes a left cushion 152 and a separate right cushion 154 with the configuration of the right cushion 154 being a mirror image of the left cushion 152. Both the left cushion 152 and right cushion 154 have an upper portion 156, a lower portion 158 and a middle portion 160 between the upper and lower portions. The upper portions 156 of the left cushion 152 and right cushion 154 preferably extend laterally outward to provide lateral support to the wheelchair occupant. The apparatus 150 also includes a set of strapping arrangements 52. Preferably there is a separate strapping arrangement 52 for the upper portion 156, lower portion 158 and middle portion 160 of the left cushion 152 and right cushion 154. The straps 54 of the strapping arrangements 52 extend through horizontally aligned corresponding sleeves 66 attached to the rear surface of the left cushion 152 and right cushion 154. The adjustment devices 58 of the strapping arrangements 52 are preferably disposed between the left cushion 152 and right cushion 154 so that adjustment of the length of the strap 54 uniformly affects the forward position of the portion of the left cushion and right cushion being adjusted and provide more uniform support to the occupant.

The left cushion 152 and right cushion 154 have a vertical length so that support may be applied vertically along the back of the wheelchair occupant. In addition, having separate strapping arrangement 52 for the upper portion 156, lower portion 158 and middle portion 160, allows the forward position of the upper, lower and middle portions to be adjusted relative to each other to vary the vertical distribution of the support exerted by the apparatus 150 on the occupant.

The spacing 162 between the left cushion 152 and right cushion 154 forms a central recess 164 to provide relief for the spinal area of the occupant. Also, when the wheelchair 12 is folded the apparatus 150 also folds along the spacing between the left cushion 152 and right cushion 154. To maintain the alignment of the left cushion 152 relative to the right cushion 154, the straps 54 of the strapping arrangements 52 preferably have a frictional fit with the sleeves 66 which maintains the position of the cushion relative to the straps 54. Also, to facilitate the adjustment of the forward position of the upper portion 156, lower portion 158 and middle portion 160 relative to each other, the left cushion 152 and right cushion 154 form corresponding pairs of horizontally aligned slits 168.

Also the lateral distance between the left cushion 152 and right cushion 154 may be varied to provide an additional adjustment feature not found in the single cushion 36.

Figure 13:
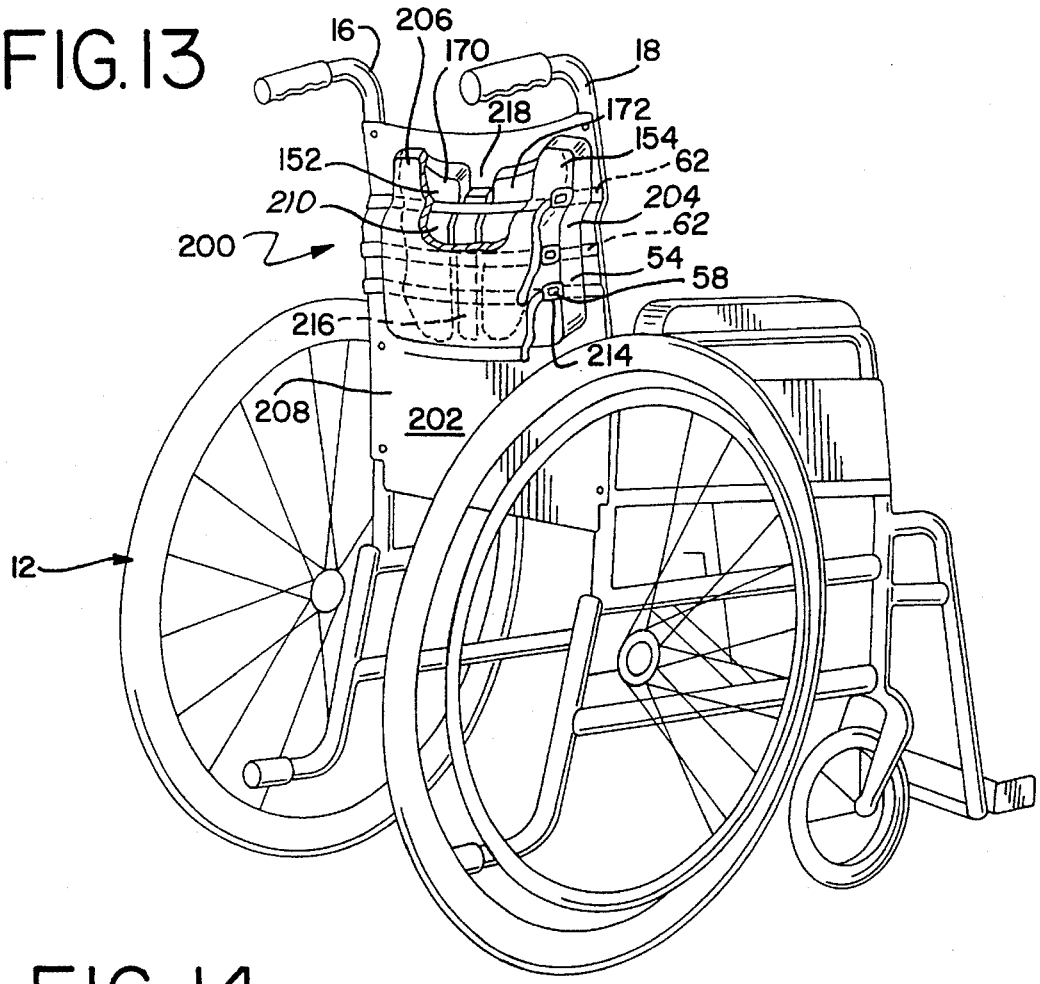
FIG. 13 is a rear perspective view with parts broken away of an apparatus constructed in accordance with yet another alternate embodiment of the present invention.

Referring to FIG. 13, a further alternate embodiment of the adjusting apparatus of the present invention, is generally indicated at 200 where the upholstery 202 of a wheelchair 12 having sling upholstery may be adapted to form a part of the adjusting apparatus 200. The upholstery 202 is configured with a pocket 204 formed by attaching a rectangular flap 206 to the rear face 208 of the upholstery. The pocket 204 may be formed with an open or enclosed top. The left cushion 152 and right cushion 154 are disposed within a chamber 210 formed within the pocket 204.

The adjusting apparatus 200 may also include the plurality of straps 54. Preferably the outer end 62 of the straps 54 are attached to the upholstery 202 in close proximity to the posts 16, 18 by sewing, adhesive or the like. Each of the straps extends horizontally along the rear face 208 of the upholstery 202 and into the pocket 204. Within the pocket, the straps extend about a rear surface 170 of the left cushion 152 and rear surface 172 of right cushion 154. Preferably there are three straps 54 to extend about the rear of the upper portion 156, lower portion 158 and middle portion 160 of the left and right cushions 152, 154. Because the left cushion 152 and right cushion 154 are disposed within the pocket 204 it is not necessary that the straps 54 be attached to the cushions. The adjusting device 58 is exposed to the exterior of the pocket 204 by apertures 214 formed in the flap 206. To maintain the separation and alignment of the left cushion 152 and right cushion 154, a spacer cushion 216 may be disposed between the left and right cushions. The spacer cushion 216 is preferably made of a soft foam and has a forward thickness less than the left cushion 152 and right cushion 154 so that a central recess 218 is formed between a left cushion and right cushion. The soft foam prevents the spacer cushion 216 from exerting a contact force on the spinal area of the occupant which may cause discomfort.

Figure 15:
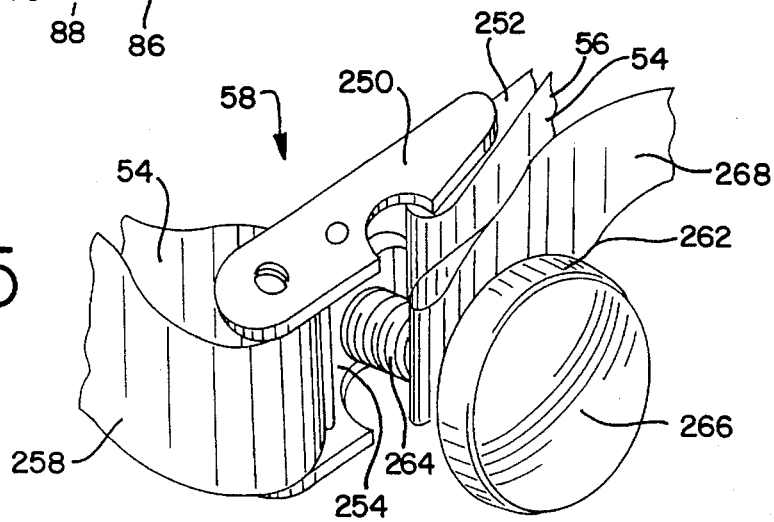
FIG. 15 is a rear perspective view of an adjustment device forming a part of the apparatus of FIG. 1.

Referring FIG. 15, a preferred embodiment of the adjusting device 58 for the strapping arrangement is illustrated. The adjusting device 58 includes a cam buckle 250. One of the end pieces 56 forming the strap 54 forms a permanent loop 252 to engage one end of the buckle 250. The other end piece 56 forms an adjusting strap 258 which extends through the buckle 250 and is releasably engaged by a cam 254. As is well known in the art, the cam buckle 250 allows the user to pull on the adjusting strap 258 and reduced the total length of the strap 54. But, when the pulling of the adjusting strap 258 drops, the cam 254 engages the adjusting strap 258 to prevent slippage of the adjusting strap through buckle 250.

Also as is well known in the art, to lengthen the strap 54 the cam 254 is depressed which disengages the cam from the adjusting strap 258. Upon this engagement, the adjusting strap 258 slides freely through the cam buckle 250 so that total length of the strap 54 may be increased.

Depressing of the cam 254 may present a problem for persons having low hand function. Therefore, the preferred embodiment of the cam buckle 250 also includes an actuation button 262. The actuation button has a stem 264 which is threadably engaged to the cam 254. The stem extends rearward and a button head 266 is attached to the rearward end of the stem. Depression of the button head 266 presses the cam 254 to allow lengthening of the strap 254. The cam buckle 250 may also include a buckle strap 268 which engages the stem 264 of the button 262. Pulling of the buckle strap 268 also acts to press the cam 254 so that the length of the strap 54 may be increased.

Referring back to FIGS. 1, 11 and 13, the cushions 36, 102, 152, 154 of the various embodiments may be composed of various types of materials. Preferably, the front face 42 of the cushion is resilient with the cushion composed of covered foam, expanded rubber, or the like. In addition, the cushion may be constructed so that the front face is firm. For example, the cushion may be formed of rigid plastic; however, due to comfort considerations a resilient front face is preferred.

The cushion 36 may also be formed so that the user may alter the configuration of the cushion by carving, abrasion or the like. Also, the support supplied by the apparatus may be varied by increasing or decreasing the thickness of the cushion.

Also it is envisioned that the straps 54 may be composed of a wide variety of materials and the attachment between the cushioning arrangement 34 and the straps may also be achieved by attaching the strap to the cushion 34 with fixed connections such as adhesive, sewing or the like.

Moreover, it is also contemplated that the ends 62 of the strap 54 may be operably attached to the vertical posts 16, 18 with other types of removable connectors or fixedly attached to the vertical posts with bolts, rivets or the like. Among other contemplated connections is attaching the end 62 of the strap directly to the upholstery 22 with sewing, adhesive or the like.

A specific embodiment of the novel back apparatus according to the present invention has been described for the purposes of illustrating the manner in which the invention may be made and used. It should be understood that implementation of other variations and modifications of the invention in its various aspects will be apparent to those skilled in the art, and that the invention is not limited by the specific embodiment described. It is therefore contemplated to cover by the present invention any and all modifications, variations, or equivalents that fall within the true spirit and scope of the basic underlying principles disclosed and claimed herein.

What is claimed is:

1. A combination for providing support to the back of an occupant of a chair, comprising:

a flexible upholstery including a forward face toward the occupant, a rear face and two vertical side edge portions;

at least two generally vertical support posts, said support posts being a part of the chair, one of said support posts attached to each of said side edge portions, said upholstery extending between said support posts;

cushion means contacting said rear face of said upholstery when the occupant leans against said upholstery for supporting at least a portion of the back of the occupant; and strap means extending from said cushion means and removably secured to each of said support posts, said strap means being adjustable as to length for laterally positioning said cushion means at a desired location along said rear face of said upholstery.

2. The combination of claim 1 wherein said cushion means includes a cushion having a front face configured to produce a desired distribution of support along a portion of the back of the occupant.

3. The combination of claim 2 wherein said front face of said cushion forms a central recess between two side sections.

4. The combination of claim 1 wherein said cushion means includes at least two cushions, said cushions being separated to form a recess.

5. The combination of claim 1 wherein the upholstery includes a pocket forming an internal chamber, said cushioning means being disposed in the chamber with said strap means extending through the pocket.

6. A combination of an apparatus and a chair, the chair having two generally vertical support posts and a backrest having a flexible upholstery extending between the support posts for supporting the back of an occupant, the upholstery having a rear face and two vertical side edge portions, the two vertical side edge portions supported by the support posts, said apparatus comprising:

cushion means, contacting the rear face of the upholstery when the occupant leans against the upholstery, for providing support to at least a portion of the back of the occupant; and strap means involving at least one strap extending between said cushion means and said support posts, being removably attached to the chair at each support post and being adjustable in length for laterally positioning said cushion means at a desired location along the rear face of said upholstery, said strap means connected to and extending from said cushion means.

7. The apparatus of claim 6 wherein said cushion means includes a cushion having a front face configured to produce a desired distribution of support along a portion of the back of the occupant.

8. The apparatus of claim 7 wherein said front face of said cushion forms a central recess between two side sections.

9. The apparatus of claim 6 wherein said cushion means includes at least two cushions, said cushions being separated to form a recess.

10. The apparatus of claim 9 wherein said strap means includes a plurality of straps, said cushions being movably positioned along said straps.

11. The apparatus of claim 6 wherein said strap means includes adjusting means for adjusting the length of said strap means to position said cushion means relative to the support posts.

12. The apparatus of claim 6 wherein the upholstery includes a pocket disposed on the rear face of the upholstery, the pocket forming an internal chamber, said cushioning means being disposed in the chamber with said strap means extending through the pocket.

13. The apparatus of claim 6 wherein said strap means is fixedly engaged to the support posts.

14. The apparatus of claim 6 wherein the chair may be folded by moving the support posts generally adjacent each other said strap means remaining fixedly engaged to each of the support posts when the chair is folded.

* * * * *